US007526935B2

(12) United States Patent
Huang et al.

(10) Patent No.: US 7,526,935 B2
(45) Date of Patent: May 5, 2009

(54) METHOD FOR REKEYING A REKEYABLE LOCK CYLINDER

(75) Inventors: Lien-Hsi Huang, Kaohsiung (TW); Ping-Hung Hsieh, Gangshan Town (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 0 days.

(21) Appl. No.: 11/984,881

(22) Filed: Nov. 23, 2007

(65) Prior Publication Data

US 2009/0078012 A1 Mar. 26, 2009

(30) Foreign Application Priority Data

Sep. 26, 2007 (TW) ..... 96135687 A

(51) Int. Cl.
*E05B 27/04* (2006.01)
*E05B 29/04* (2006.01)

(52) U.S. Cl. ..... 70/360; 70/340; 70/341; 70/383; 70/384; 70/492; 70/493; 70/495

(58) Field of Classification Search ..... 70/360, 70/361, 337–343, 386, 387, 492–496, DIG. 22, 70/DIG. 75
See application file for complete search history.

(56) References Cited

U.S. PATENT DOCUMENTS 3,485,068 A * 12/1969 Bennett ..... 70/360
3,667,262 A * 6/1972 Hill ..... 70/384
3,999,413 A * 12/1976 Raymond et al. ..... 70/495
4,376,382 A * 3/1983 Raymond et al. ..... 70/338
6,119,495 A * 9/2000 Loreti ..... 70/340
6,263,713 B1 * 7/2001 Fantl ..... 70/492
6,860,131 B2 3/2005 Armstrong et al. ..... 70/492
6,862,909 B2 3/2005 Armstrong et al. ..... 70/492
6,871,520 B2 3/2005 Armstrong et al. ..... 70/492
6,959,569 B2 11/2005 Strader et al. ..... 70/492
6,968,717 B2 * 11/2005 Suzuki et al. ..... 70/492
7,007,528 B2 * 3/2006 Chong et al. ..... 70/492
7,114,357 B2 10/2006 Armstrong et al. ..... 70/492
7,117,701 B2 10/2006 Armstrong et al. ..... 70/492
7,213,429 B2 5/2007 Armstrong et al. ..... 70/492
7,234,331 B2 6/2007 Armstrong et al. ..... 70/492
7,424,815 B1 * 9/2008 Pagnoncelli ..... 70/340
2004/0060331 A1 4/2004 Armstrong et al. ..... 70/383
2004/0060333 A1 4/2004 Armstrong et al. ..... 70/493
2004/0163433 A1 8/2004 Armstrong et al. ..... 70/493

(Continued)

*Primary Examiner*—Lloyd A Gall

(57) ABSTRACT

This invention is to provide a method for rekeying a rekeyable lock cylinder. The first step of entire rekeying process is to insert a first user key into a keyhole of a sliding block of a plug assembly and turn the first user key to rotate the plug assembly, then a thrust is added to the first user key to move the sliding block of the plug assembly, thereby disengaging a plurality of upper locking pieces and a plurality of lower locking pieces within a plurality of lower pin sets. Next, after pulling out the first user key from the keyhole, a second user key is inserted into the keyhole of the sliding block and turned to restore the sliding block as to reengage the upper locking pieces and the lower locking pieces. Finally, the second user key is pulled out to complete the entire rekeying process. Accordingly, the present invention may provide advantages of widely lowering rekeying cost and enhancing convenience in use, because lock replacement may be completed as soon as rekeying another user key only without replacing lock cylinder.

8 Claims, 16 Drawing Sheets

U.S. PATENT DOCUMENTS

2005/0011242 A1 1/2005 Armstrong et al. ..... 70/493
2005/0016234 A1 1/2005 Strader et al. ..... 70/492
2005/0039506 A1 2/2005 Armstrong et al. ..... 70/492
2005/0039507 A1 2/2005 Armstrong et al. ..... 70/492
2005/0103073 A1 5/2005 Armstrong et al. ..... 70/493
2005/0155399 A1 7/2005 Armstrong et al. ..... 70/493
2006/0277956 A1 12/2006 Armstrong et al. ..... 70/492

* cited by examiner

METHOD FOR REKEYING A REKEYABLE LOCK CYLINDER

FIELD OF THE INVENTION

The present invention generally relates to an operating method of lock cylinder and more particularly to a method for rekeying a rekeyable lock cylinder.

BACKGROUND OF THE INVENTION

Lock cylinder of a conventional lock device typically is matched with a proper key so lock cylinder as well as key must be replaced in pair while replacing a lock, which results in high lock-replacing cost and inconvenient use.

SUMMARY

An object of the present invention is to provide a method for rekeying a rekeyable lock cylinder. The first step of entire rekeying process is to insert a first user key into a keyhole of a sliding block of a plug assembly and turn the first user key to rotate the plug assembly, then a thrust is added to the first user key to move the sliding block of the plug assembly, thereby disengaging a plurality of upper locking pieces and a plurality of lower locking pieces within a plurality of lower pin sets. Next, after pulling out the first user key from the keyhole, a second user key is inserted into the keyhole of the sliding block and turned to restore the sliding block as to reengage the upper locking pieces and the lower locking pieces. Finally, the second user key is pulled out to complete the entire rekeying process. Accordingly, the present invention may provide advantages of widely lowering rekeying cost and enhancing convenience in use, because lock replacement may be completed as soon as rekeying another user key only without replacing lock cylinder.

A rekeyable lock cylinder in accordance with the present invention includes a shell, a plug assembly and a plurality of pin sets. The shell has a hollow cylindrical portion and an extending protrusion formed at a lateral of the hollow cylindrical portion, and defines a central axis. Wherein the hollow cylindrical portion has an inside wall, an outside wall and a plurality of runners that communicate with the inside wall and the outside wall, the extending protrusion has a plurality of upper pin holes that communicate with the hollow cylindrical portion. The plug assembly is disposed in the hollow cylindrical portion of the shell and includes a plug body having a front section, a middle section, a driving portion, a coupling groove and a plurality of lower pin holes, and a sliding block. Wherein the coupling groove is formed at the front section and the middle section, the lower pin holes are formed at the middle section, the sliding block that is disposed in the coupling groove of the plug body and able to move parallel to the central axis of the shell has a plurality of pin-sliding grooves and a keyhole communicating with the pin-sliding grooves. Each pin set includes an upper pin and a lower pin set, wherein the upper pin is moveably disposed at one or more upper pin hole of the extending protrusion and at one or more lower pin hole of the plug body, the lower pin set is moveably disposed at one or more lower pin hole of the plug body and at one or more pin-sliding groove of the sliding block and includes an upper locking piece, a lower locking piece able to engage with the upper locking piece and a resilient member disposed between the upper locking piece and the lower locking piece.

A plug assembly of a rekeyable lock cylinder in accordance with the present invention includes a plug body and a sliding block. The plug body has a front section, a middle section, a driving portion, a coupling groove and a plurality of lower pin holes, and defines a central line. The coupling groove is formed at the front section and the middle section, the lower pin holes are formed at the middle section. The sliding block that is disposed at the coupling groove of the plug body and able to move parallel to the central line has a plurality of pin-sliding grooves and a keyhole communicating with the pin-sliding grooves.

A plug body of a plug assembly in accordance with the present invention has a front section, a middle section, a driving portion, a coupling groove and a plurality of lower pin holes. The coupling groove is formed at the front section and the middle section, the lower pin holes are formed at the middle section.

A sliding block of a plug assembly in accordance with the present invention has a plurality of pin-sliding grooves and a keyhole communicating with the pin-sliding grooves.

A lower pin set of a pin set in accordance with the present invention includes an upper locking piece, a lower locking piece and a resilient member. The lower locking piece engages with the upper locking piece, the resilient member is disposed between the upper locking piece and the lower locking piece.

Shell of a rekeyable lock cylinder in accordance with the present invention has a hollow cylindrical portion and an extending protrusion formed at a lateral of the hollow cylindrical portion. The hollow cylindrical portion has an inside wall, an outside wall and a plurality of runners that communicate with the inside wall and the outside wall, the extending protrusion has a plurality of upper pin holes communicating with the hollow cylindrical portion, wherein the runners extend to the extending protrusion and communicate with the upper pin holes.

A method for rekeying a rekeyable lock cylinder in accordance with the present invention includes providing a rekeyable lock cylinder that has a shell, a plug assembly and a plurality of pin sets. The plug assembly is disposed within the shell and has a plug body and a sliding block that is disposed in the plug body and axially moveable has a keyhole. Each pin set has one or more lower pin set that is moveably disposed within the plug body and at least includes an upper locking piece and a lower locking piece engaging with the upper locking piece. First, a first user key is inserted into the keyhole of the sliding block and turned to rotate the plug assembly, and then a thrust is added onto the first user key to move the sliding block as to disengage the upper locking pieces and the lower locking pieces. Next, after pulling out the first user key from the keyhole, a second user key is inserted into the keyhole of the sliding block and turned to restore the sliding block as to reengage the upper locking pieces and the lower locking pieces. Finally, the second user key is pulled out to complete the entire rekeying process.

DETAILED DESCRIPTION OF THE INVENTION

Figure 1:
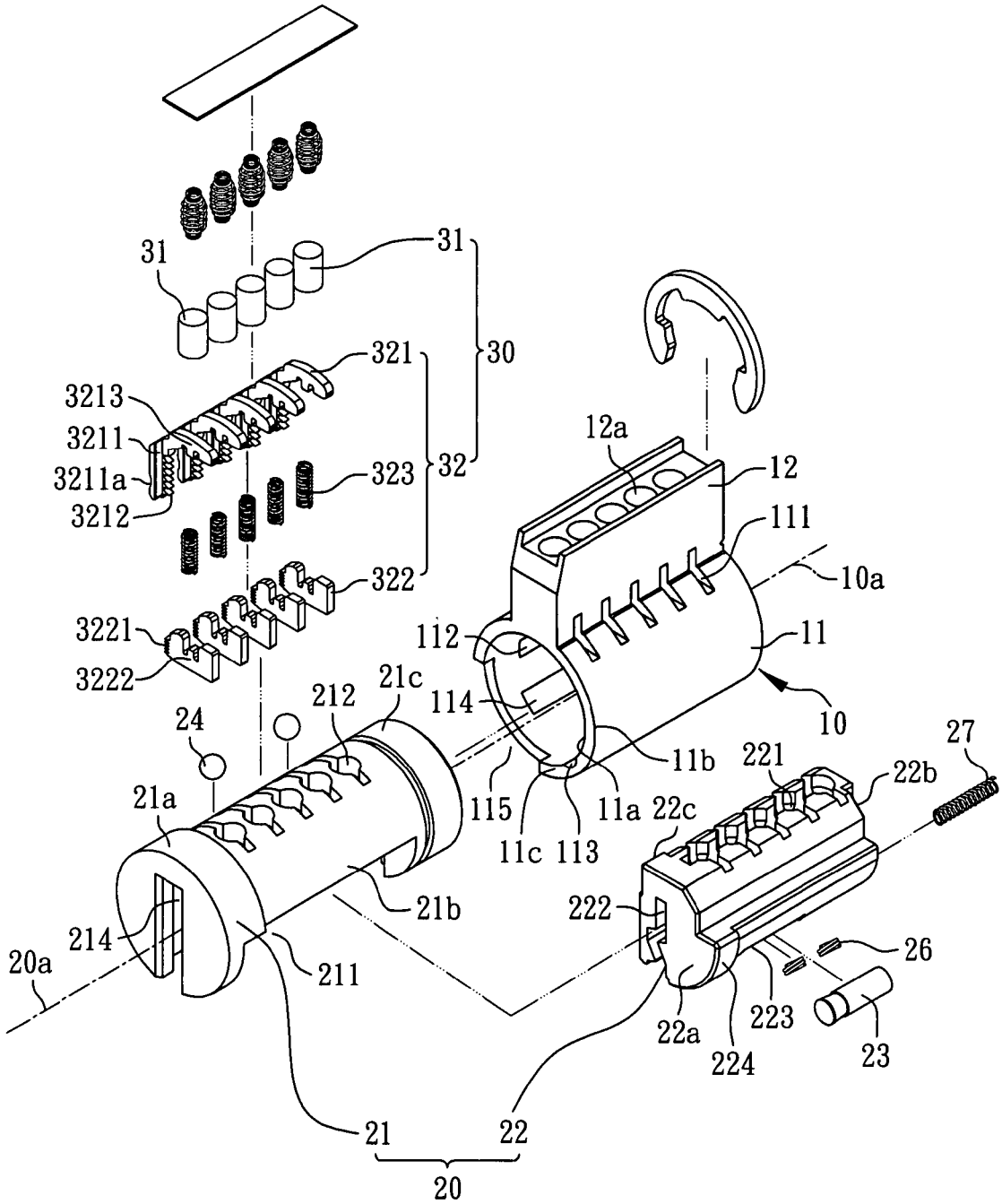
FIG. 1 is an exploded perspective view of a rekeyable lock cylinder in accordance with a preferred embodiment of the present invention.
Figure 2:
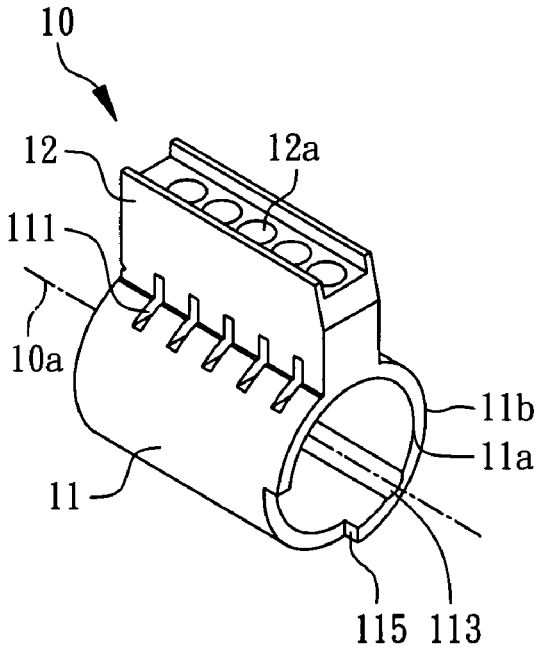
FIG. 2 is a perspective view of a shell in accordance with a preferred embodiment of the present invention.
Figure 3:
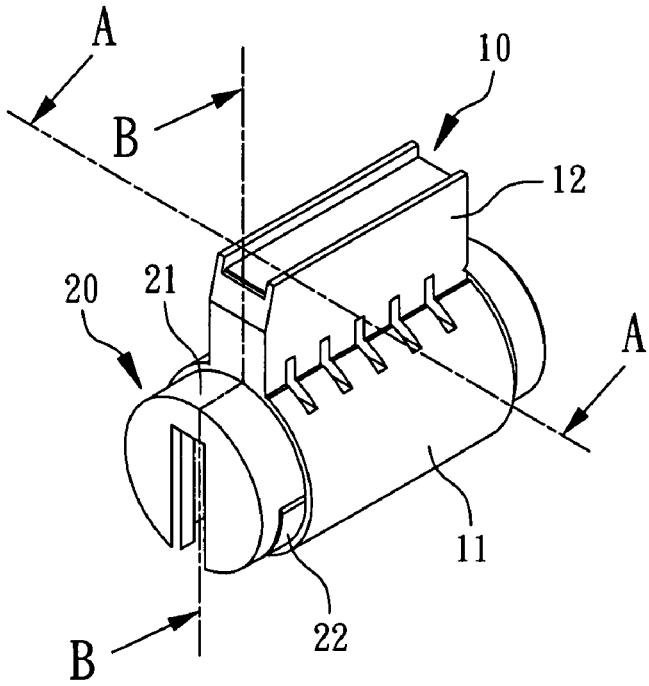
FIG. 3 is an assembled perspective view of the rekeyable lock cylinder in accordance with a preferred embodiment of the present invention.
Figure 4:
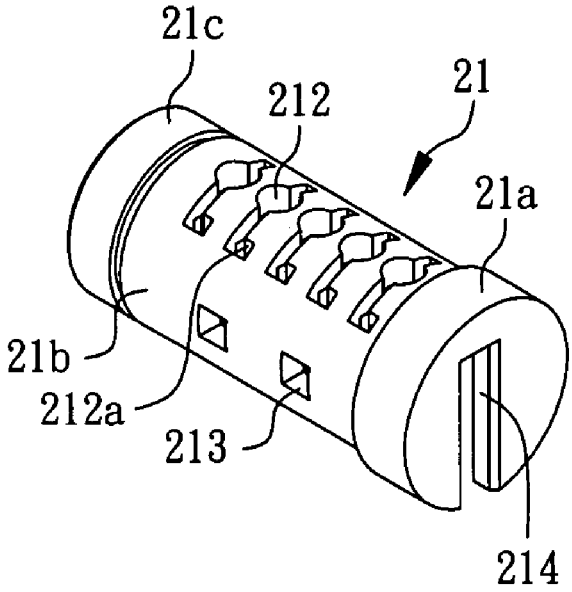
FIG. 4 is a perspective view of a plug body in accordance with a preferred embodiment of the present invention.
Figure 5:
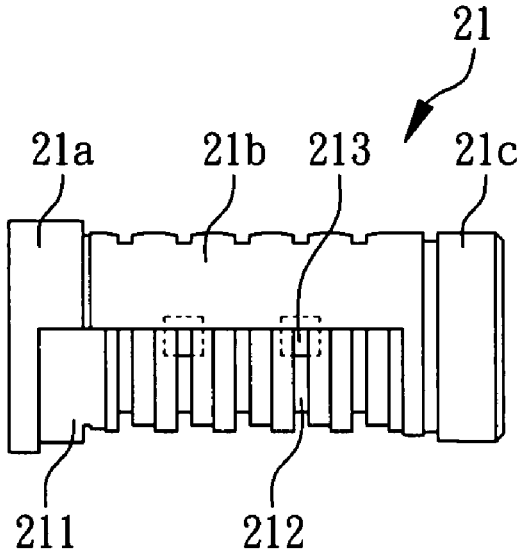
FIG. 5 is a front plan view of the plug body in accordance with a preferred embodiment of the present invention.

A rekeyable lock cylinder in accordance with a preferred embodiment of the present invention, as shown in FIGS. 1 and 2, includes a shell 10, a plug assembly 20 and a plurality of pin sets 30. The shell 10 has a hollow cylindrical portion 11 and an extending protrusion 12 formed at a lateral of the hollow cylindrical portion 11, and defines a central axis 10*a*. The hollow cylindrical portion 11 has an inside wall 11*a*, an outside wall 11*b*, an ending surface 11*c*, a plurality of runners 111 communicating with the inside wall 11*a* and the outside wall 11*b*, a burglarproof slot 112, a first slot 113, a second slot 114 and an accommodating gap 115 recessed on the ending surface 11*c*. The burglarproof slot 112, the first slot 113 and the second slot 114 are formed at the inside wall 11*a*, the first slot 113 is adjacent to the ending surface 11*c* and the second slot 114 is located below the accommodating gap 115. In this embodiment, the first slot 113 and the second slot 114 are in parallel and disposed alternately. The accommodating gap 115 is formed at one end of the hollow cylindrical portion 11. The extending protrusion 12 has a plurality of upper pin holes 12*a* that communicate with the hollow cylindrical portion 11. In this embodiment, the runners 111 of the hollow cylindrical portion 11 extend to the extending protrusion 12 and communicates with the upper pin holes 12*a* of the extending protrusion 12.

Figure 6:
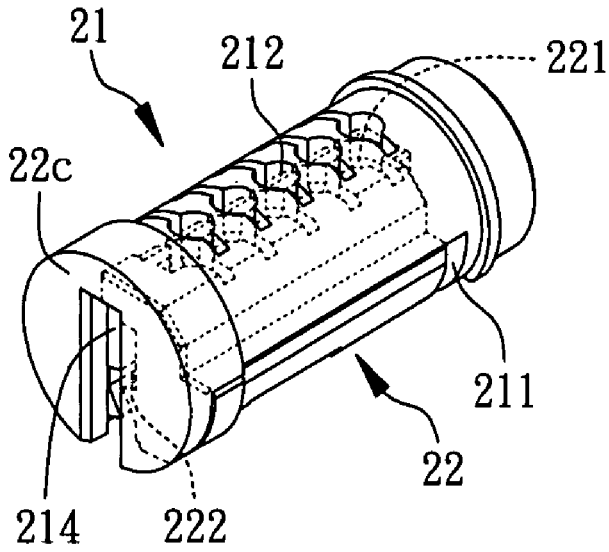
FIG. 6 is an assembled view of a sliding block and the plug body in accordance with a preferred embodiment of the present invention.
Figure 7:
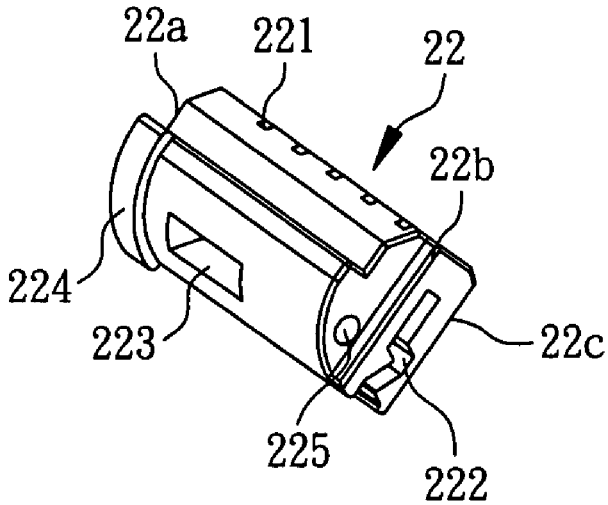
FIG. 7 is a perspective view of the sliding block in accordance with a preferred embodiment of the present invention.

As shown in FIGS. 1, 3, 4 and 5, the plug assembly 20 is disposed within the hollow cylindrical portion 11 of the shell 10 and includes a plug body 21, a sliding block 22, a limit member 23 and a burglarproof member 24. The plug body 21 has a front section 21*a*, a middle section 21*b*, a driving portion 21*c*, a coupling groove 211, a plurality of lower pin holes 212, one or more opening 213 and an axial groove 214, and defines a central line 20*a*. The central line 20*a* is parallel to and overlapped onto the central axis 10*a* of the shell 10. The coupling groove 211 is formed at the front section 21*a* and the middle section 21*b*. The lower pin holes 212 are formed at the middle section 21*b* and have an extending slide groove 212*a*. The opening 213 is formed at the middle section 21*b* and communicates with one or more lower pin hole 212. The axial groove 214 is formed at the front section 21*a*. As shown in FIGS. 1 and 6, the sliding block 22 is disposed at the coupling groove 211 of the plug body 21 and able to axially move parallel to the central axis 10*a* of the shell 10 or the central line 20*a*. As shown in FIGS. 1, 6, 7 and 8, the sliding block 22 has a first end 22*a*, a second end 22*b*, a join surface 22*c*, a plurality of pin-sliding grooves 221, a keyhole 222 and a cavity 223. The first end 22*a* has a flange 224 that corresponds to the accommodating gap 115 of the hollow cylindrical portion 11 of the shell 10, and an insertion slot 225 is recessed at the second end 22*b*. The join surface 22*c* faces the opening 213 of the plug body 21. In this embodiment, the keyhole 222 communicates with the first end 22*a*, the second end 22*b* and the pin-sliding grooves 221. Otherwise, in another embodiment, while the key is relatively short, the keyhole 222 merely needs to communicate with the first end 22*a* and the pin-sliding grooves 221, and which corresponds to the axial groove 214 of the plug body 21. The pin-sliding grooves 221 are located below the lower pin holes 212 of the plug body 21.

Figure 8:
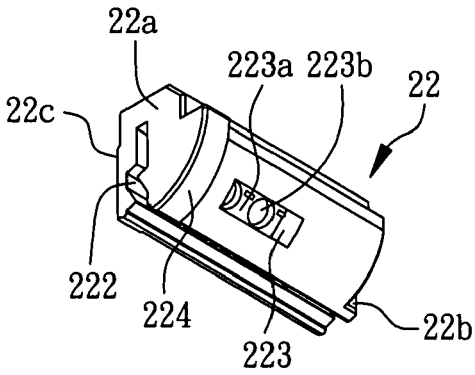
FIG. 8 is another perspective view of the sliding block in accordance with a preferred embodiment of the present invention.
Figure 9:
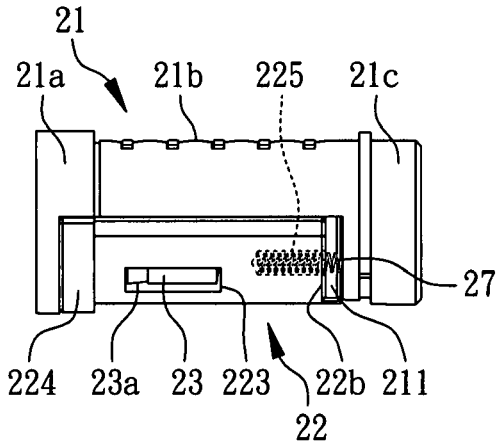
FIG. 9 is an assembled side view of the sliding block and the plug body in accordance with a preferred embodiment of the present invention.
Figure 10:
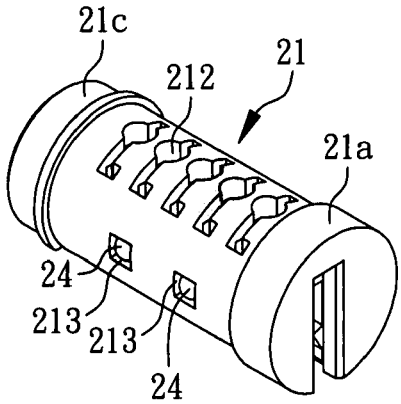
FIG. 10 is an assembled view of a burglarproof member and the plug body in accordance with a preferred embodiment of the present invention.

In this embodiment as shown in FIGS. 1 and 9, the limit member 23 being a pillar is disposed at the cavity 223 of the sliding block 22 and preferably there is a reducing portion 23*a* at one end of the limit member 23. Besides, as shown in FIGS. 1 and 8, the plug assembly 20 further includes one or more thrust member 26, the cavity 223 of the sliding block 22 has a bottom 223*a* and one or more positioning groove 223*b* recessing at the bottom 223*a*, and the thrust member 26 may be disposed within the positioning groove 223*b* of the bottom 223*a* in order to push the limit member 23. As shown in FIGS. 1 and 10, the burglarproof member 24 substantially employs steel ball in this embodiment and is disposed at the opening 213 of the plug body 21.

Figure 11:
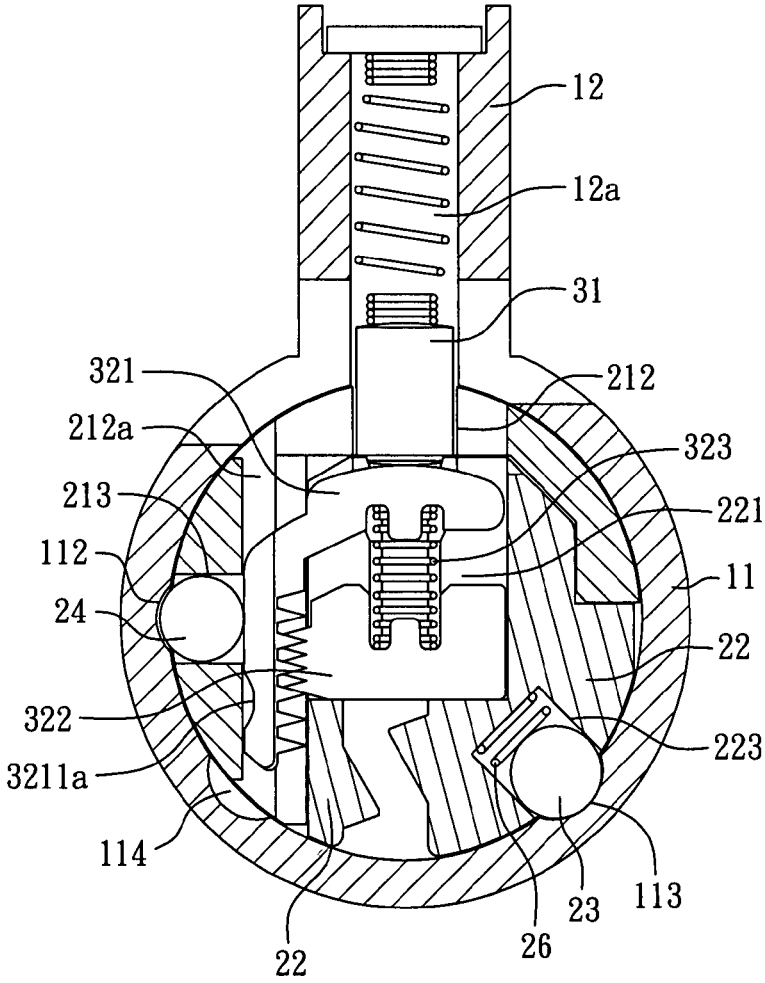
FIG. 11 is an assembled longitudinal section view of the rekeyable lock cylinder taken along line A-A of FIG. 3.
Figure 12:
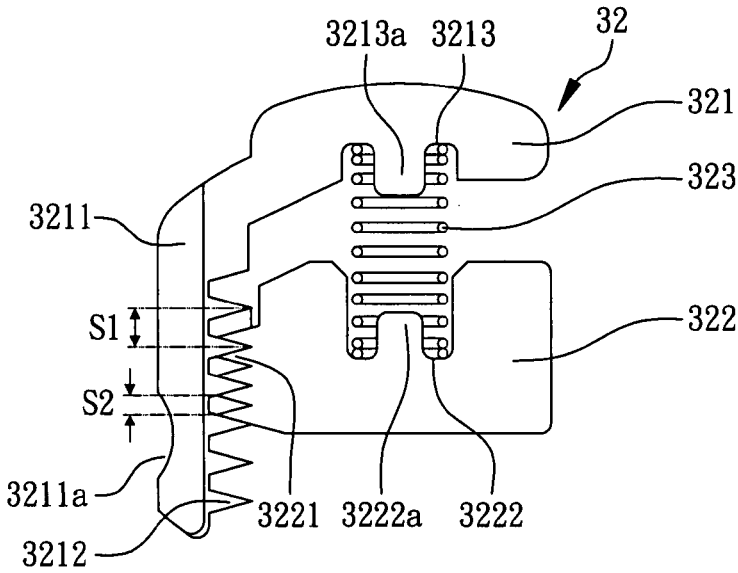
FIG. 12 is a view of a lower pin set structure in accordance with a preferred embodiment of the present invention.

As shown in FIGS. 1, 11 and 12, each pin set 30 includes an upper pin 31 and a lower pin set 32, wherein the upper pin 31 is moveably disposed at one or more upper pin hole 12*a* of the extending protrusion 12 of the shell 10 and one or more lower pin hole 212 of the plug body 21, the lower pin set 32 is moveably disposed within one or more lower pin hole 212 of the plug body 21 and one or more pin-sliding groove 221 of the sliding block 22. In this embodiment, the lower pin set 32 is substantially height-adjustable pin including an upper locking piece 321, a lower locking piece 322 able to engage with the upper locking piece 321 and a resilient member 323 disposed between the upper locking piece 321 and the lower locking piece 322. In this embodiment, the resilient member 323 is a spring and the upper locking piece 321 has a rib 3211, an upper tooth portion 3212 and an upper fixing portion 3213. The rib 3211, which forms a relieving groove 3211*a*, is moveably disposed at the extending slide groove 212*a* of the lower pin hole 212 and capable of guiding the upper locking piece 321 to move longitudinally as well as preventing the upper locking piece 321 from transversely moving. The upper tooth portion 3212 is formed at the rib 3211 and has a first tooth interval S1, the upper fixing portion 3213 has an upper pillar 3213*a*, and the lower locking piece 322 includes a lower tooth portion 3221 having a second tooth interval S2 and a lower fixing portion 3222 having a lower pillar 3222*a*. In this embodiment as shown in FIG. 12, the upper tooth portion 3212 of the upper locking piece 321 engages with the lower tooth portion 3221 of the lower locking piece 322 and the first tooth interval S1 is greater than the second tooth interval S2 or may be equal in another embodiment. Moreover, two ends of the resilient member 323 are practically fixed at the upper fixing portion 3213 and the lower fixing portion 3222 respectively, preferably at the upper pillar 3213*a* of the upper fixing portion 3213 and the lower pillar 3222*a* of the lower fixing portion 3222 respectively.

In this embodiment as shown in FIG. 11, while the rekeyable lock cylinder is not inserted by a proper key, the cavity 223 of the sliding block 22 corresponds to the first slot 113 of the hollow cylindrical portion 11 and the limit member 23 is pushed by the thrust member 26 to enter into the first slot 113 of the hollow cylindrical portion 11. Besides, the opening 213 of the plug body 21 corresponds to the burglarproof slot 112 of the hollow cylindrical portion 11 that catches the burglarproof member 24. Therefore, in addition to that the plug body 20 cannot be turned because the upper pin 31 of the pin set 30 is lower than the turning interface, the burglarproof member 24 is also caught by the burglarproof slot 112, so it is able to effectively prevent the burglary from unlocking by impacting lock to rotate the plug body 20 in this embodiment.

Figure 13:
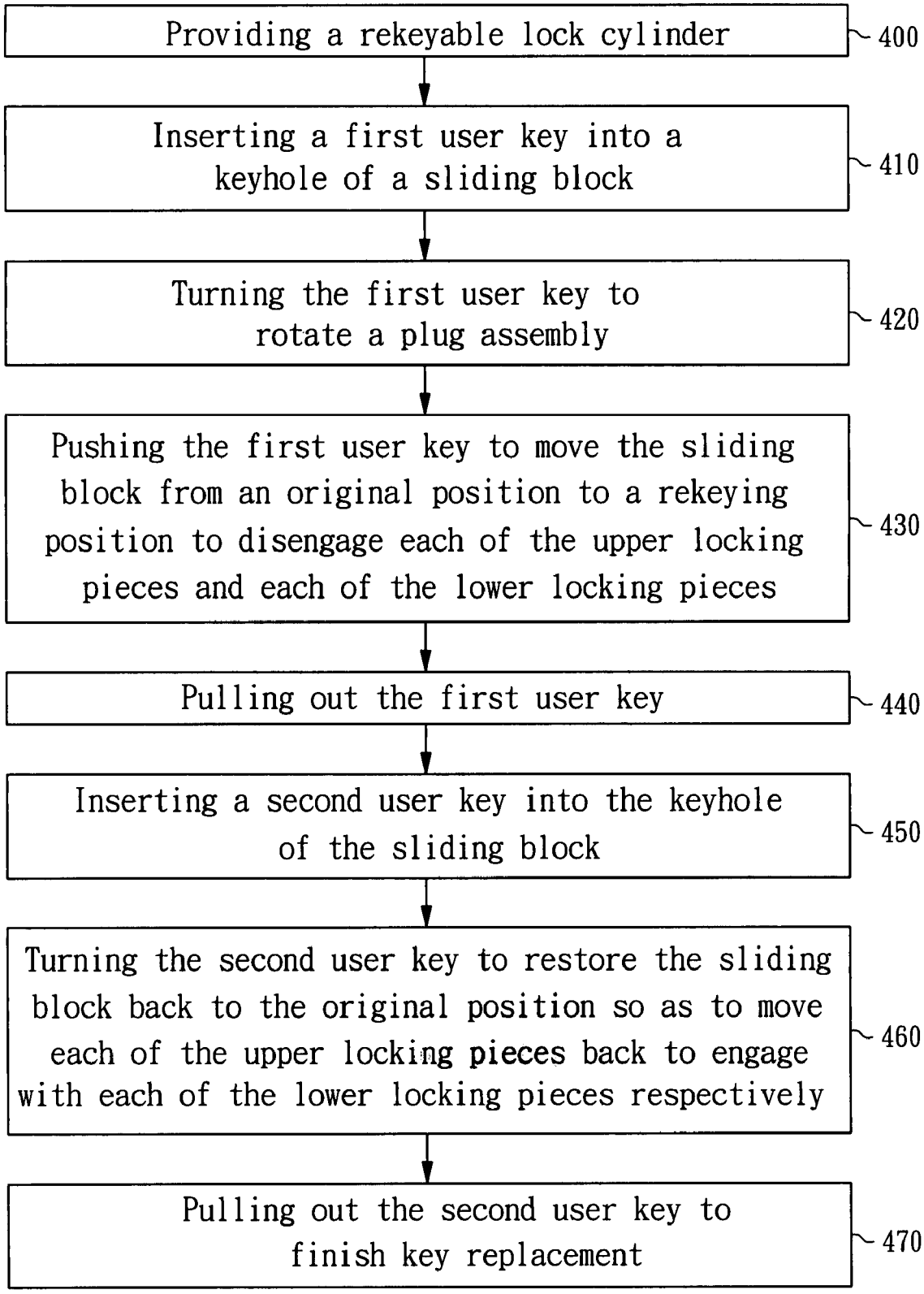
FIG. 13 is a flow chart for rekeying the rekeyable lock cylinder in accordance with a preferred embodiment of the present invention.
Figure 14:
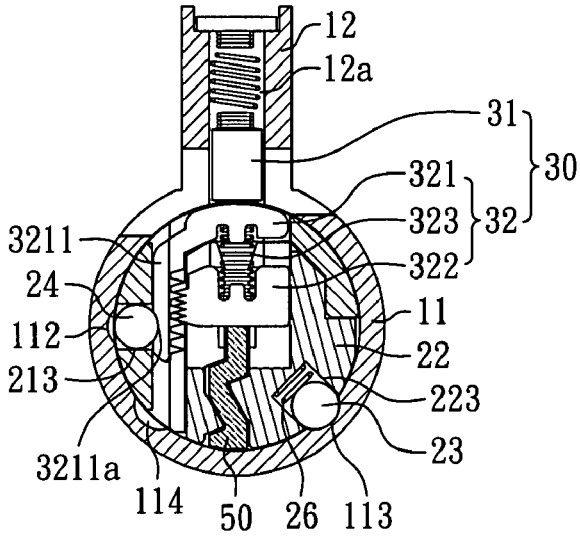
FIG. 14 is a longitudinal section view illustrating a first user key is inserted into the rekeyable lock cylinder in accordance with a preferred embodiment of the present invention.
Figure 15:
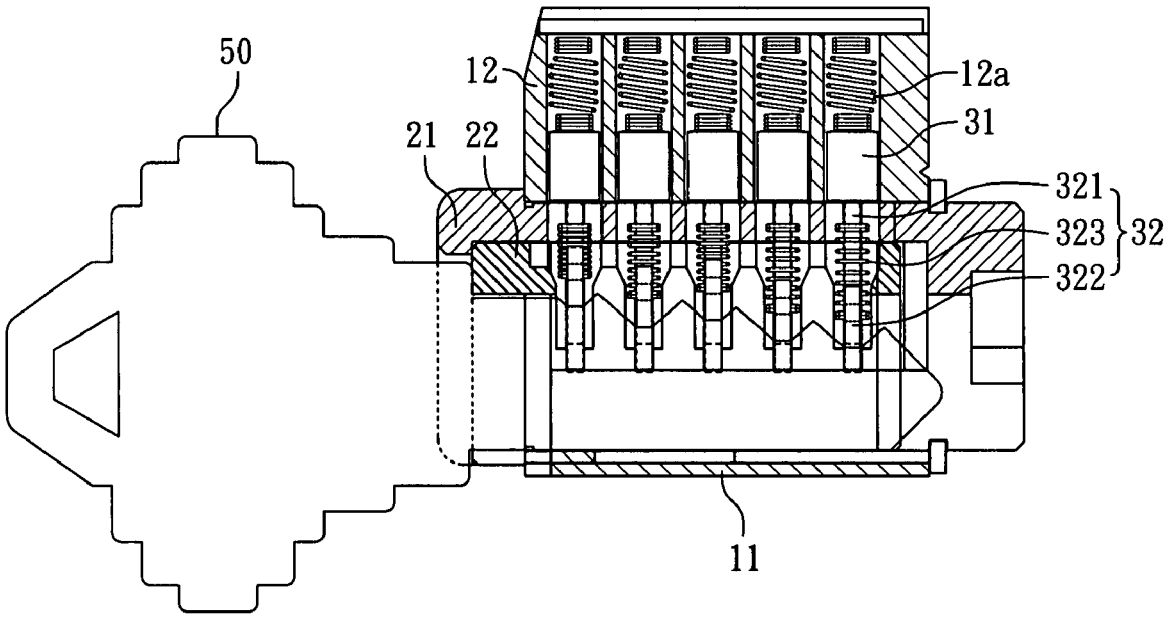
FIG. 15 is a transverse section view illustrating the rekeyable lock cylinder taken along line B-B of FIG. 3.
Figure 16:
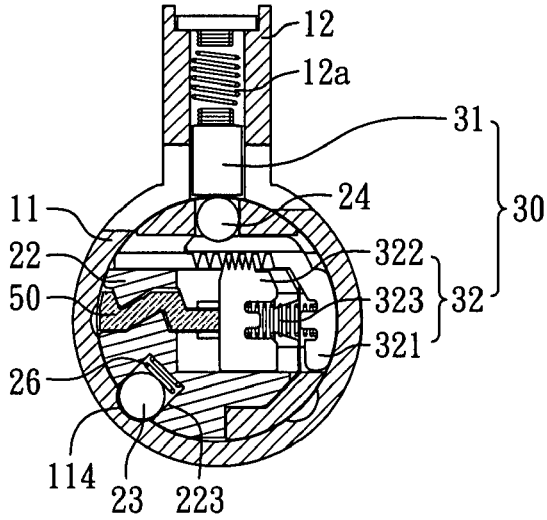
FIG. 16 is a longitudinal section view illustrating the first user key is turned in 90° clockwise in accordance with a preferred embodiment of the present invention.
Figure 17:
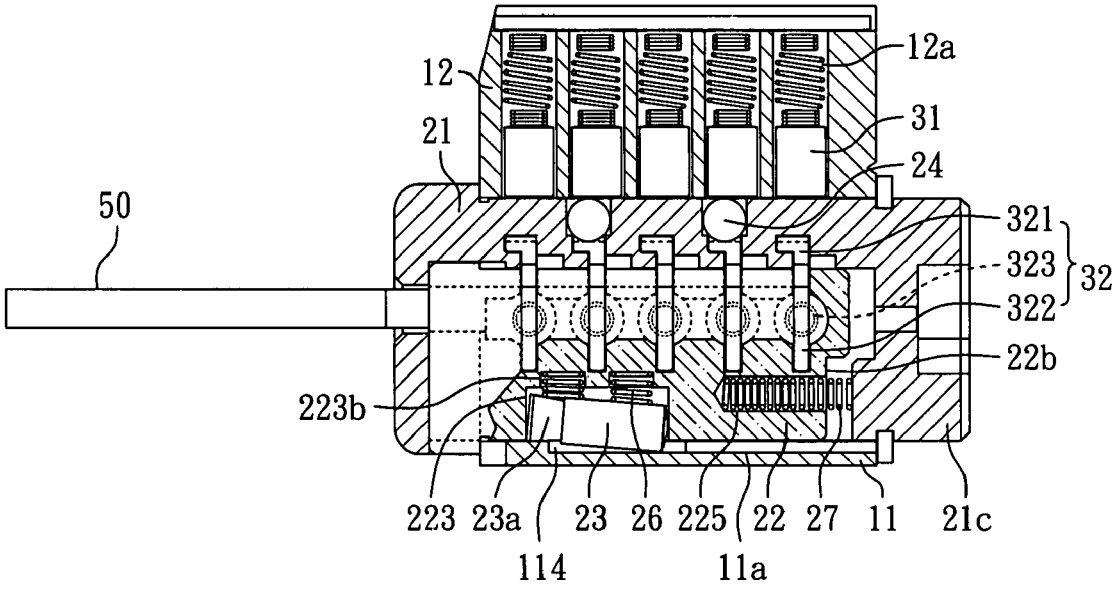
FIG. 17 is a transverse section view illustrating the first user key is turned in 90° clockwise in accordance with a preferred embodiment of the present invention.
Figure 18:
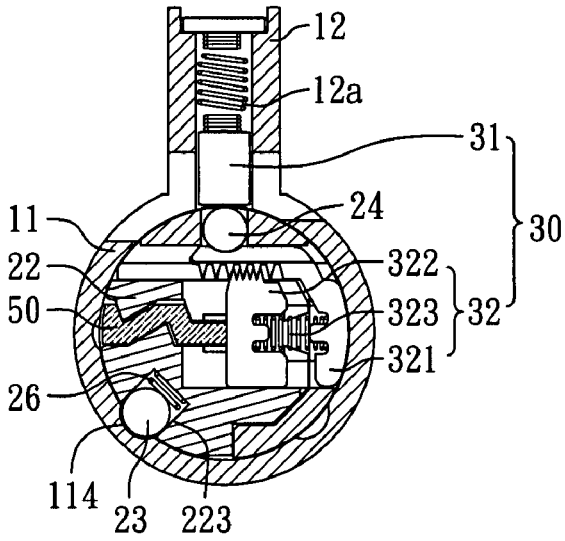
FIG. 18 is a longitudinal section view illustrating the disengagement of the upper locking pieces and the lower locking pieces due to the moved sliding block in accordance with a preferred embodiment of the present invention.
Figure 19:
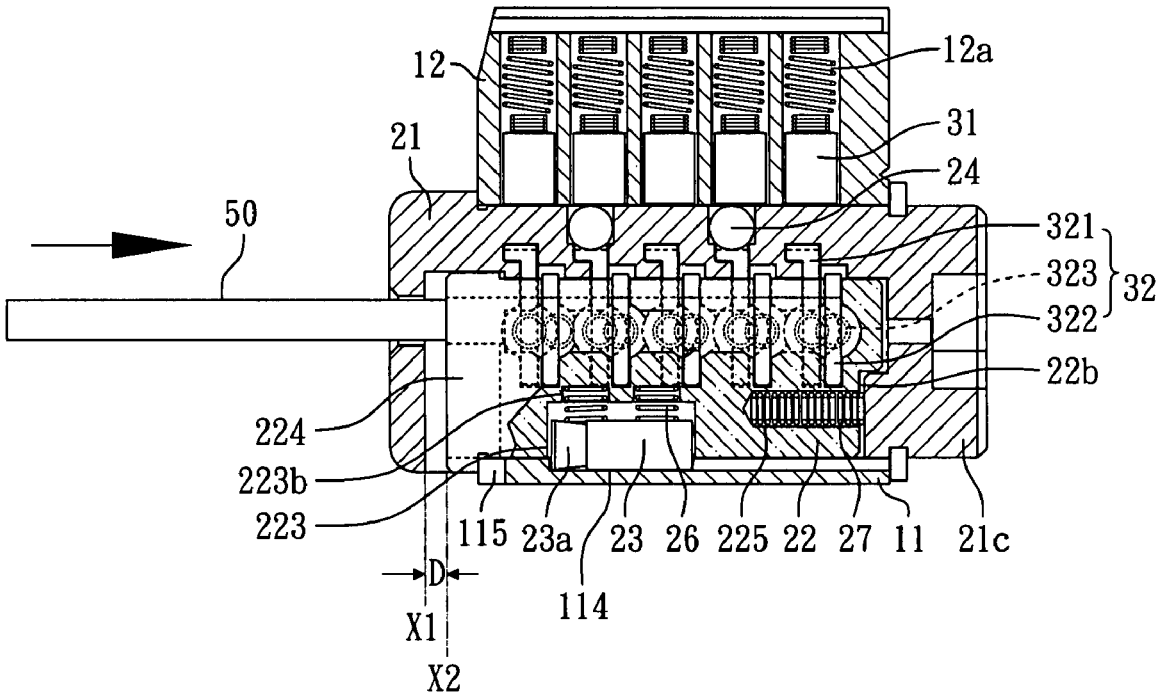
FIG. 19 is a transverse section view illustrating the disengagement of the upper locking pieces and the lower locking pieces due to the moved sliding block in accordance with a preferred embodiment of the present invention.
Figure 20:
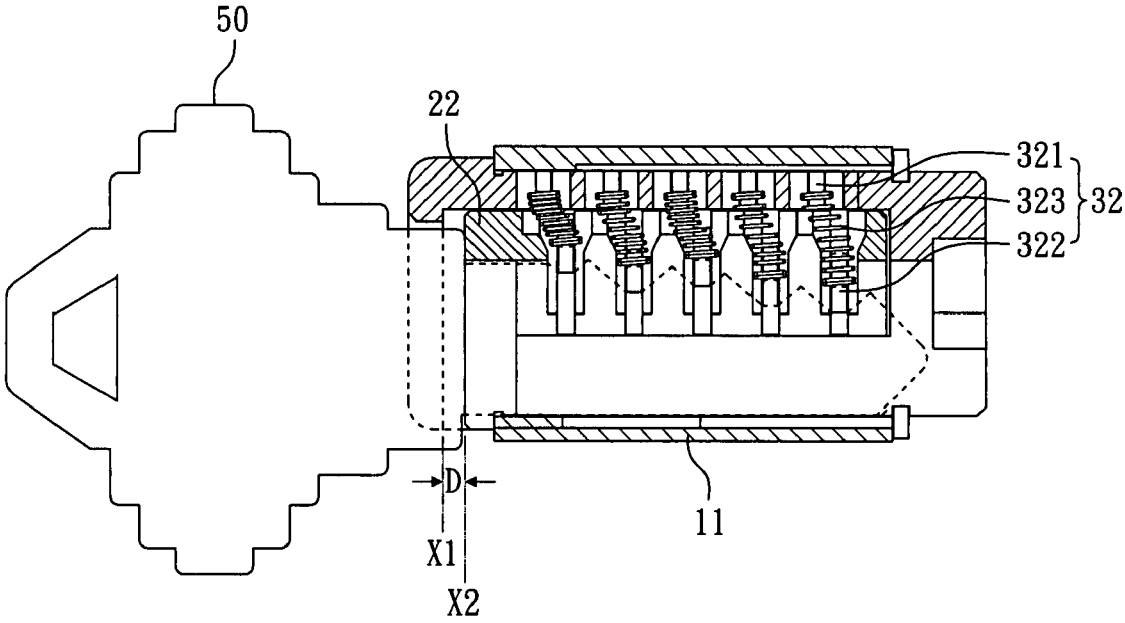
FIG. 20 is another transverse section view illustrating the disengagement of the upper locking pieces and the lower locking pieces due to the moved sliding block in accordance with a preferred embodiment of the present invention.
Figure 21:
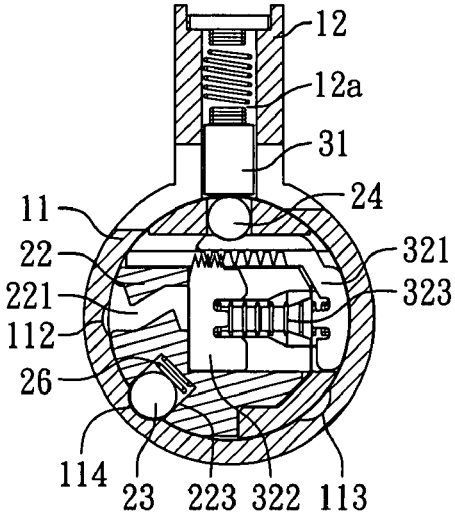
FIG. 21 is a longitudinal section view illustrating the first user key is pulled out in accordance with a preferred embodiment of the present invention.
Figure 22:
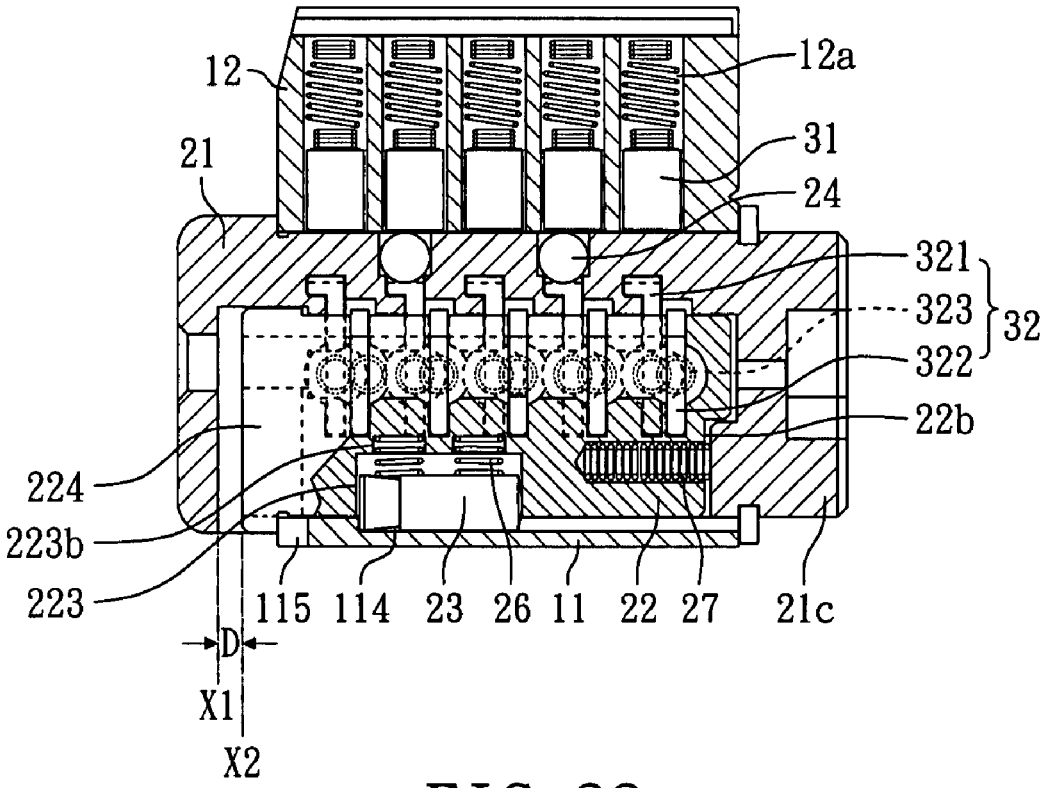
FIG. 22 is a transverse section view illustrating the first user key is pulled out in accordance with a preferred embodiment of the present invention.
Figure 23:
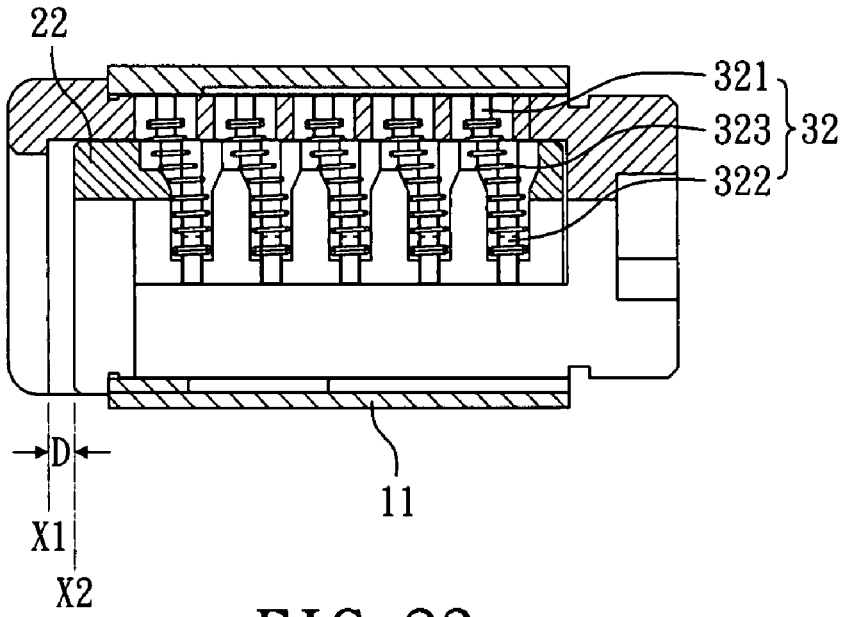
FIG. 23 is another transverse section view illustrating the first user key is pulled out in accordance with a preferred embodiment of the present invention.
Figure 24:
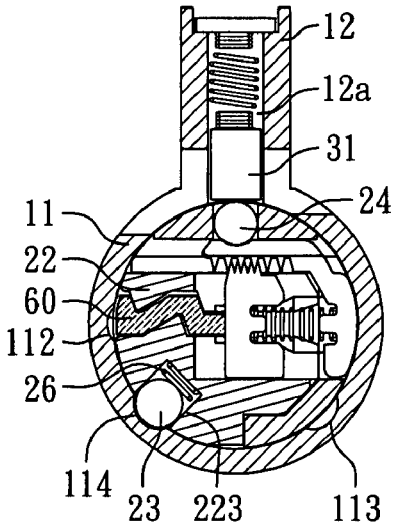
FIG. 24 is a longitudinal section view illustrating a second user key is inserted into the rekeyable lock cylinder in accordance with a preferred embodiment of the present invention.
Figure 25:
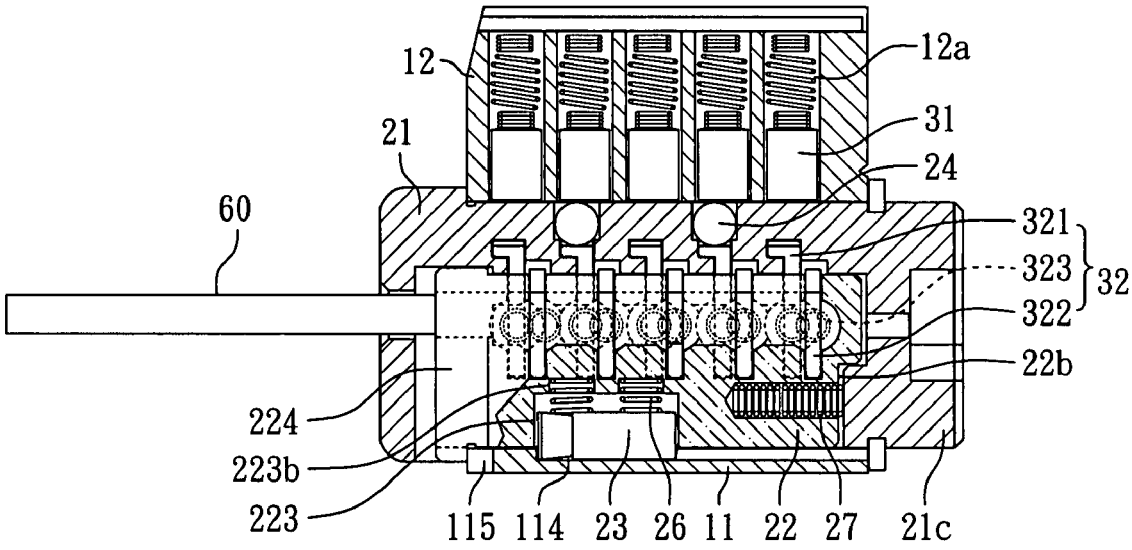
FIG. 25 is a transverse section view illustrating the second user key is inserted into the rekeyable lock cylinder in accordance with a preferred embodiment of the present invention.
Figure 26:
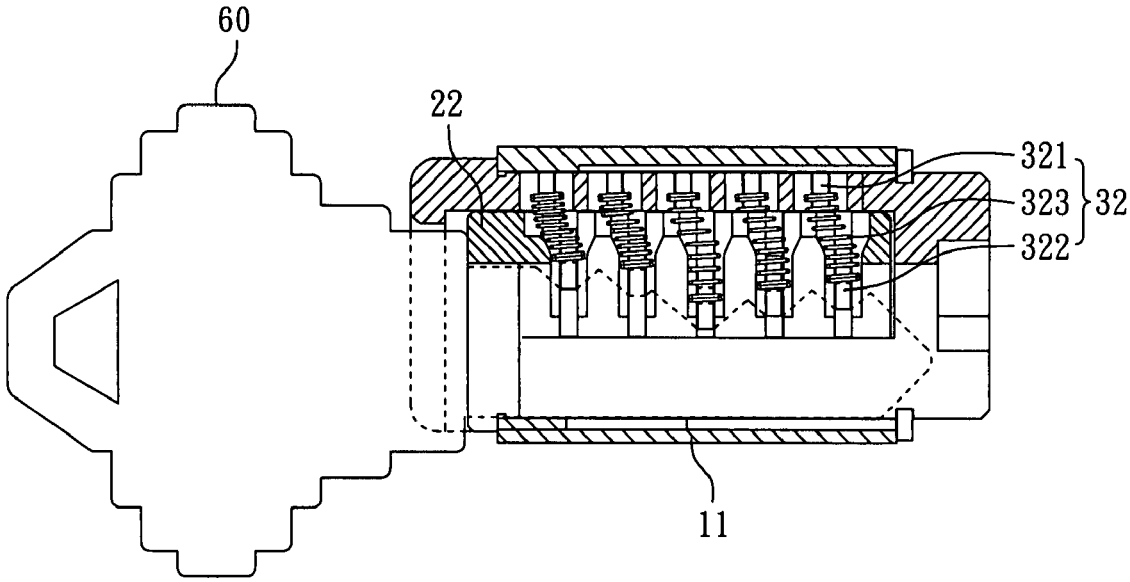
FIG. 26 is another transverse section view illustrating the second user key is inserted into the rekeyable lock cylinder in accordance with a preferred embodiment of the present invention.
Figure 27:
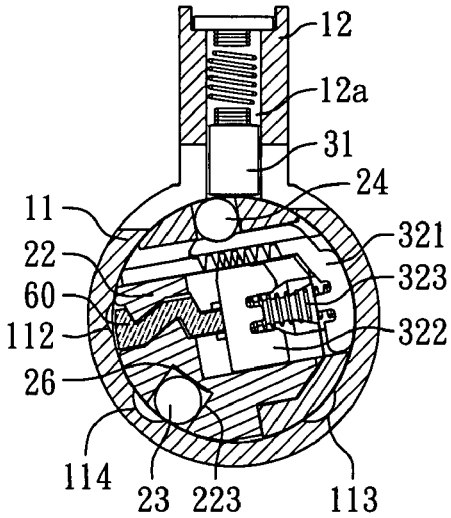
FIG. 27 is a longitudinal section view illustrating the second user key is turned counterclockwise in accordance with a preferred embodiment of the present invention.
Figure 28:
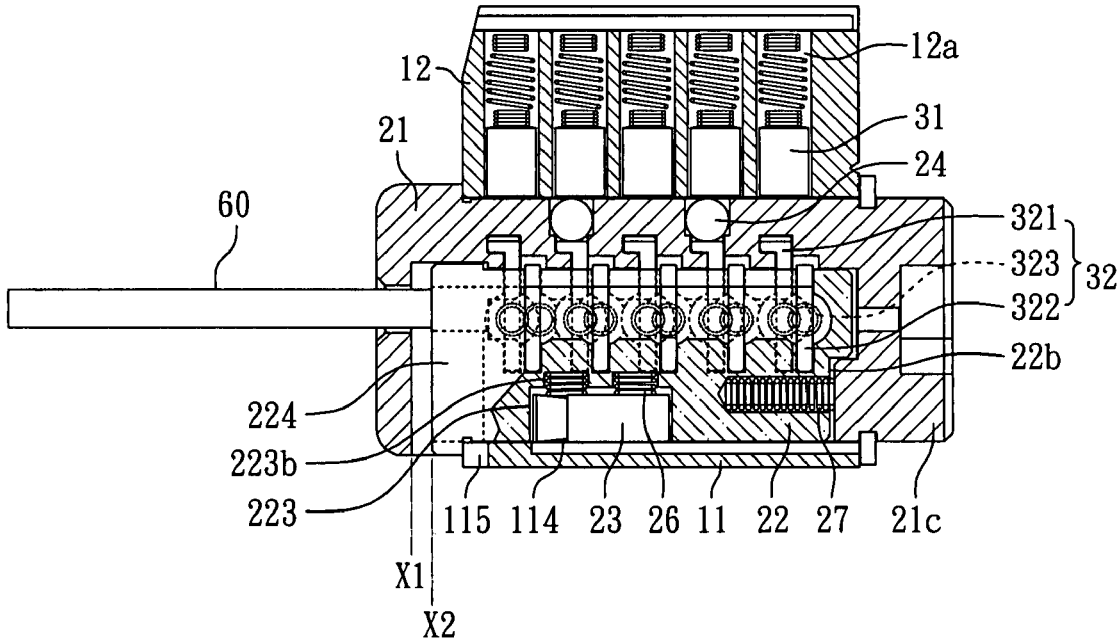
FIG. 28 is a transverse section view illustrating the second user key is turned counterclockwise in accordance with a preferred embodiment of the present invention.
Figure 29:
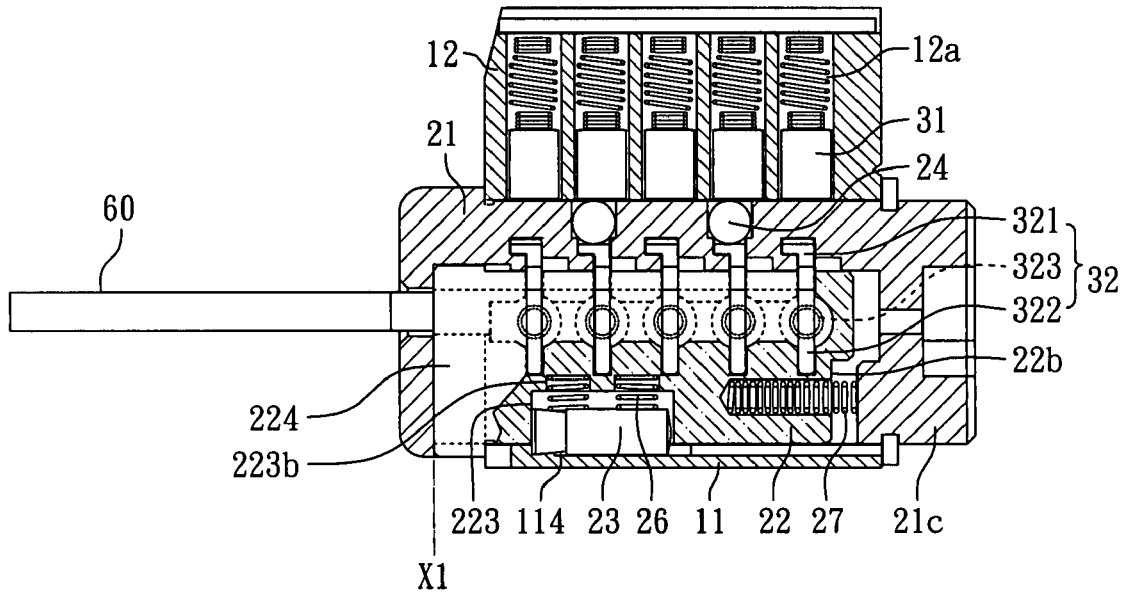
FIG. 29 is a longitudinal section view illustrating the second user key is turned in 90° counterclockwise in accordance with a preferred embodiment of the present invention.
Figure 30:
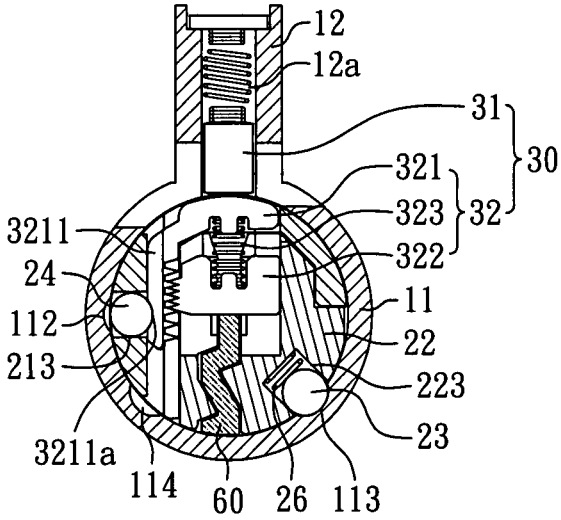
FIG. 30 is a transverse section view illustrating the second user key is turned in 90° counterclockwise in accordance with a preferred embodiment of the present invention.
Figure 31:
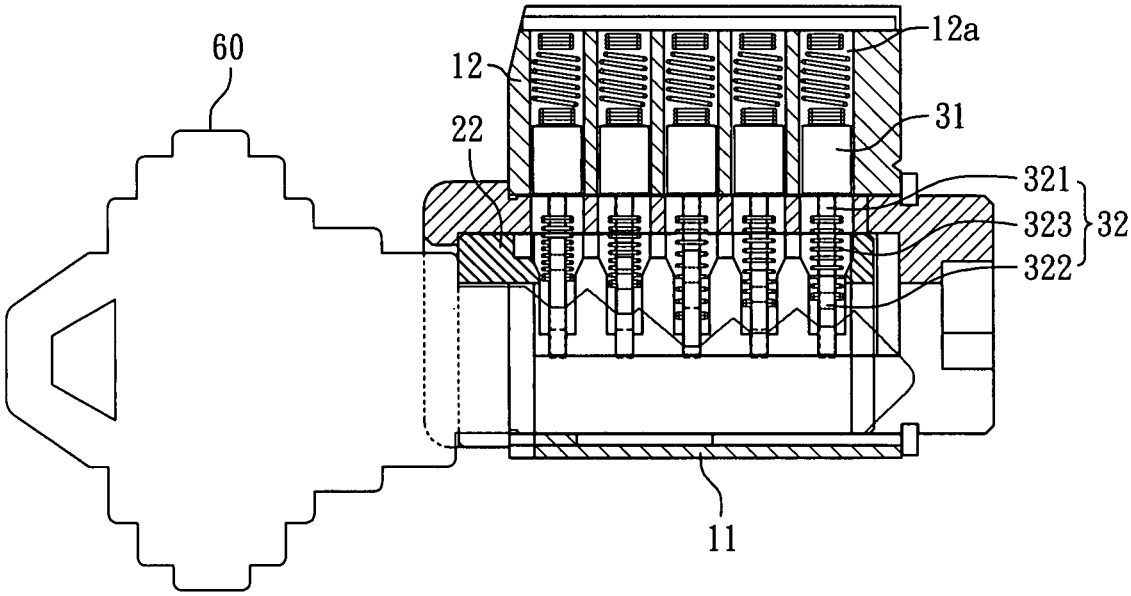
FIG. 31 is another transverse section view illustrating the second user key is turned in 90° counterclockwise in accordance with a preferred embodiment of the present invention.

As shown in FIG. 13, the method for rekeying the rekeyable lock cylinder will be described in detail as follows. First, a rekeyable lock cylinder is provided referring to the step 400, and then a first user key 50 is inserted into the keyhole 222 of the sliding block 22 referring to the step 410. In this embodiment as shown in FIGS. 14 and 15, the first user key 50 pushes the lower pin set 32 upwardly moving and being aligned with the turning interface. Meanwhile, the receiving groove 3211*a* of the rib 3211 of the upper locking piece 321, the burglarproof member 24, the opening 213 and the burglarproof slot 112 are corresponding to one another to further relieve the catching state of the burglarproof member 24 and the burglarproof slot 112 of the hollow cylindrical portion 11, which allows the upper pin 31 of the pin set 30 to be elevated by the lower pin set 32 and aligned with the turning interface. Next, the first user key 50 is turned to rotate the plug body 20 to a predetermined degree referring to step 420, in this embodiment, the first user key 50 is clockwise turned about 90°. As shown in FIGS. 16 and 17, since the cavity 223 of the sliding block 22 corresponds to the second slot 114 of the hollow cylindrical portion 11 and the limit member 23 is pushed by the thrust member 26, one end of the limit member 23 will enter into the second slot 114 of the hollow cylindrical portion 11. Meanwhile, the reducing portion 23*a* of the limit member 23 will be blocked at the inside wall 11*a* without entering the second slot 114. The burglarproof member 24 practically touches the upper pin 31 in this embodiment. Besides, in this embodiment, the plug assembly 20 further includes a restoring member 27 that is disposed between the second end 22*b* of the sliding block 22 and the driving portion 21*c* of the plug body 21 and is preferably disposed in an insertion slot 225 of the sliding block 22 and touches the driving portion 21*c* of the plug body 21. Next, referring to step 430, pushing the first user key 50 that allows the sliding block 22 of the plug assembly 20 to axially move from an original position X1 to a rekeying position X2 so as to disengage each of the upper locking pieces 321 and each of the lower locking pieces 322. In this embodiment as shown in FIGS. 18, 19 and 20, the sliding block 22 moves in an interval D, which simultaneously pushes the lower locking pieces 322 of the lower pin sets 32 moving in an interval D resulting in disengagement of the lower locking pieces 322 and the upper locking pieces 321, as well as makes the reducing portion 23*a* of the limit member 23 move in an interval D to enter into the second slot 114 of the hollow cylindrical portion 11. Meanwhile, the limit member 23 completely enters into and is caught by the second slot 114, thus the sliding block 22 is limited at the rekeying position X2 via the limit member 23. In this embodiment, for the purpose that the sliding block 22 can move smoothly, the flange 224 of the sliding block 22 may correspond to the accommodating gap 115 of the hollow cylindrical portion 11 of the shell 10 that provides an accommodating space for allowing the sliding block 22 to move. Next, the first user key 50 is pulled out from the keyhole 222 referring to step 440. In this embodiment as shown in FIGS. 21, 22 and 23, while the first user key 50 is pulled out from the keyhole 222, a downward movement to the lowermost position happens to the lower locking pieces 322 of the lower pin sets 32 due to the tension action of the resilient members 323. Then, a second user key 60 is inserted into the keyhole 222 of the sliding block 22 referring to step 450. In this embodiment as shown in FIGS. 24, 25 and 26, the lower locking pieces 322 of the lower pin sets 32 will readjust profile for matching different bitting profile with respect to the second user key 60. Next, the second user key 60 is turned to restore the sliding block 22 back to original position X1 referring to step 460. In this embodiment, the second user key 60 is counterclockwise turned about 90° so as to move each of the upper locking pieces 321 back to engage with each of the lower locking pieces 322 respectively. As shown in FIGS. 27, 28, 29, 30 and 31, while the second user key 60 is turned, the limit member 23 moves to the inside wall 11*a* of the hollow cylindrical portion 11 escaping from and relieving caught state by the second slot 114. Meanwhile, the sliding block 32 and the lower locking pieces 322 of the lower pin sets 32 are pushed by the restoring member 27 to restore, and the lower locking pieces 322 reengages with the upper locking pieces 321. Finally, the second user key 60 is pulled out from the keyhole 222 to complete the entire rekeying process.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A method for rekeying a rekeyable lock cylinder comprising:

providing a rekeyable lock cylinder having a plug assembly and a plurality of lower pin sets disposed in the plug assembly, the plug assembly includes a plug body and a sliding block disposed in the plug body and able to axially move, wherein the sliding block has a keyhole defined therein and each of the lower pin set sets includes an upper locking piece and a lower locking piece engaging with the upper locking piece respectively;

inserting a first user key into the keyhole of the sliding block;

turning the first user key to rotate the plug assembly to a predetermined degree;

pushing the first user key to move the sliding block from an original position to a rekeying position to disengage each of the upper locking pieces and each of the lower locking pieces;

pulling out the first user key;

inserting a second user key into the keyhole of the sliding block; and turning the second user key to restore the sliding block back to the original position so as to move each of the upper locking pieces back to engage with each of the lower locking pieces respectively.

2. The method of claim 1, wherein turning the first user key to rotate the plug assembly to a predetermined degree involves clockwise turning the first user key about 90°.

3. The method of claim 1, wherein turning the second user key to restore the sliding block back to the original position involves counterclockwise turning the second user key about 90°.

4. The method of claim 1, further comprising a step of pulling out the second user key.

5. The method of claim 1, wherein the rekeyable lock cylinder further comprises a shell, the plug assembly is disposed within the shell.

6. The method of claim 1, wherein each lower pin set is moveably disposed within the plug body.

7. The method of claim 1, wherein pushing the first user key to move the sliding block from an original position to a rekeying position involves using a limiting member to limit the sliding block at the rekeying position.

8. The method of claim 1, wherein turning the second user key to restore the sliding block back to the original position involves using a restoring member to push the sliding block back to the original position so as to move each of the lower locking pieces back to engage with each of the upper locking pieces respectively.

* * * * *